US005645498A

United States Patent [19]

Cretella

[11] Patent Number: 5,645,498

[45] Date of Patent: Jul. 8, 1997

[54] GOLF TEE AND BALL PLACER AND HOLDING SYSTEM

[76] Inventor: Joseph Cretella, 135-56 124th St., Ozone Park, N.Y. 11420

[21] Appl. No.: 672,968

[22] Filed: Jul. 1, 1996

[51] Int. Cl.[6] ..... A63B 57/00

[52] U.S. Cl. ..... 473/386; 473/286

[58] Field of Search ..... 473/282, 284, 473/286, 386; 294/19.2, 19.1

[56] References Cited

U.S. PATENT DOCUMENTS

| | | | |
|---|---|---|---|
| 4,951,947 | 8/1990 | Kopfle | 473/386 |
| 5,080,239 | 1/1992 | Rowland | 473/282 |
| 5,285,990 | 2/1994 | Engel | 473/282 |
| 5,306,000 | 4/1994 | Comella | 473/386 |
| 5,494,279 | 2/1996 | Ahner | 473/386 |
| 5,540,432 | 7/1996 | Keller | 473/386 |

*Primary Examiner*—Steven B. Wong

[57] ABSTRACT

A new Golf Tee and Ball Placer and Holding System for facilitating the placement of a golf tee into the playing surface in the desired position to receive the golf ball for play and the placement of the golf ball on the tee for play and the recovery of the tee without requiring the player to bend down for such placement and recovery. The inventive device includes a hollow shaft including a tee receiving opening in operative relationship to a tee retaining area, a golf ball holding member comprising a hollow shaft member passage, a notched golf ball holder, a golf tee retriever, and a golf tee slot, and a golf tee and ball placer holder having a handle for pushing the opposite end into the ground in an upright position and a club holder incorporated into the handle.

11 Claims, 3 Drawing Sheets

GOLF TEE AND BALL PLACER AND HOLDING SYSTEM

BACKGROUND OF THE INVENTION

1. Field of the Invention

The present invention relates to Golf Ball and Tee Tool Apparatus and more particularly pertains to a new Golf Tee and Ball Placer and Holding System for facilitating the placement of a golf tee into the playing surface in the desired position to receive the golf ball for play and the placement of the golf ball on the let for play without requiring the player to bend down for such placement.

2. Description of the Prior Art

The use of Golf Ball and Tee Tool Apparatus is known in the prior art. More specifically, Golf Ball and Tee Tool Apparatus heretofore devised and utilized are known to consist basically of familiar, expected and obvious structural configurations, notwithstanding the myriad of designs encompassed by the crowded prior art which have been developed for the fulfillment of countless objectives and requirements.

Known prior art Golf Ball and Tee Tool Apparatus include U.S. Pat. No. 5,306,000; U.S. Pat. No. 5,330,178; U.S. Pat. No. 331,091; U.S. Design Pat. No. 5,080,357; U.S. Design Pat. No. 5,310,177 and U.S. Design Pat. No. 5,330, 177.

While these devices fulfill their respective, particular objectives and requirements, the aforementioned patents do not disclose a new Golf Tee and Ball Placer and Holding System. The inventive device includes a hollow shaft including a tee receiving opening in operative relationship to a tee retaining area, a golf ball holding member comprising a hollow shaft member passage, a notched golf ball holder, a golf tee retriever, and a golf tee slot, and a golf tee and ball placer holder having a handle for pushing the opposite end into the ground in an upright position and a club holder incorporated into the handle.

In these respects, the Golf Tee and Ball Placer and Holding System according to the present invention substantially departs from the conventional concepts and designs of the prior art, and in so doing provides an apparatus primarily developed for the purpose of to facilitate the placement of a golf tee into the playing surface in the desired position to receive the golf ball for play and the placement of the golf ball on the tee for play and the recovery of the tee without requiring the player to bend down for such placement and recovery.

SUMMARY OF THE INVENTION

In view of the foregoing disadvantages inherent in the known types of Golf Ball and Tee Tool Apparatus devices now present in the prior art, the present invention provides a new Golf Tee and Ball Placer and Holding System construction wherein the same can be utilized for facilitating the placement of a golf tee into the playing surface in the desired position to receive the golf ball for play and the placement of the golf ball on the tee for play without requiring the player to bend down for such placement. As such, the general purpose of the present invention, which will be described subsequently in greater detail, is to provide a new Golf Tee and Ball Placer and Holding System apparatus and method which has many of the advantages of the Golf Ball and Tee Tool Apparatus mentioned heretofore and many novel features that result in a new Golf Tee and Ball Placer and Holding System which is not anticipated, rendered obvious, suggested, or even implied by any of the prior art storage devices, either alone or in any combination thereof.

To attain this, the present invention generally comprises a hollow shaft including a tee receiving opening in operative relationship to a tee retaining area, a golf ball holding member comprising a hollow shaft member passage, a notched golf ball holder, a golf tee retriever, and a golf tee slot, and a golf tee and ball placer holder having a handle for pushing the opposite end into the ground in an upright position and a club holder incorporated into the handle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Golf Tee and Ball Placer and Holding System apparatus and method which has many of the advantages of the Golf Ball and Tee Tool Apparatus mentioned heretofore and many novel features that result in a new Golf Tee and Ball Placer and Holding System which is not anticipated, rendered obvious, suggested, or even implied by any of the prior art storage devices, either alone or in any combination thereof.

It is another object of the present invention to provide a new Golf Tee and Ball Placer and Holding System which may be easily and efficiently manufactured and marketed.

It is a further object of the present invention to provide a new Golf Tee and Ball Placer and Holding System which is of a durable and reliable construction.

An even further object of the present invention is to provide a new Golf Tee and Ball Placer and Holding System which is susceptible of a low cost of manufacture with regard to both materials and labor, and which accordingly is then susceptible of low prices of sale to the consuming public, thereby making such Golf Tee and Ball Placer and Holding System economically available to the buying public.

Still yet another object of the present invention is to provide a new Golf Tee and Ball Placer and Holding System which provides in the apparatuses and methods of the prior art some of the advantages thereof, while simultaneously overcoming some of the disadvantages normally associated therewith.

Still another object of the present invention is to provide a new Golf Tee and Ball Placer and Holding System for to facilitate the placement of a golf tee into the playing surface in the desired position to receive the golf ball for play and the placement of the golf ball on the tee for play without requiring the player to bend down for such placement.

Yet another object of the present invention is to provide a new Golf Tee and Ball Placer and Holding System which includes System for facilitating the placement of a golf tee into the playing surface in the desired position to receive the golf ball for play and the placement of the golf ball on the tee for play and the recovery of the tee without requiring the player to bend down for such placement and recovery. The inventive device includes a hollow shaft including a tee receiving opening in operative relationship to a tee retaining area, a golf ball holding member comprising a hollow shaft member passage, a notched golf ball holder, a golf tee retriever, and a golf tee slot, and a golf tee and ball placer holder having a handle for pushing the opposite end into the ground in an upright position and a dub holder incorporated into the handle.

Even still another object of the present invention is to provide new Golf Tee and Ball Placer and Holding System wherein the user is able to load a golf tee into the golf tee and ball placer and project the golf tee into the playing surface using and subsequently allows the user to place the golf ball on the golf tee in position to be played and recover the golf tee without having to bend over to place the golf tee in the playing surface and place the ball on the tee.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
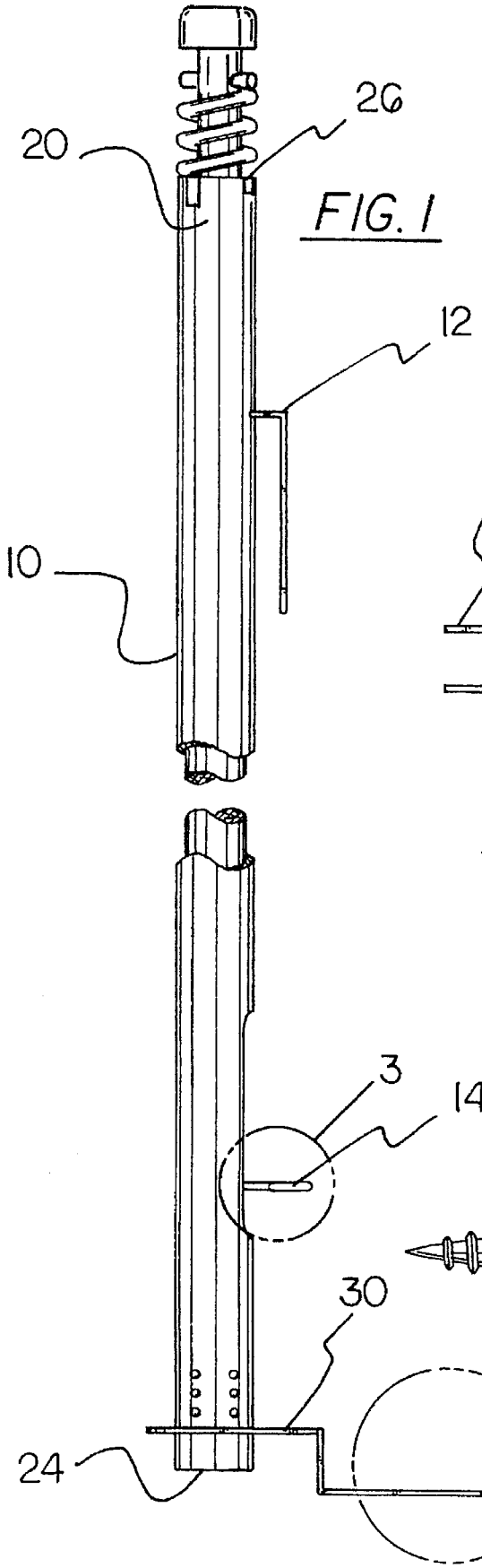
FIG. 1 is a side view of the new Golf Tee and Ball Placer and Holding System according to the present invention.

With reference now to the drawings, and in particular to FIGS. 1–7 thereof, a new Golf Tee and Ball Placer and Holding System embodying the principles and concepts of the present invention and generally designated by the reference numeral 10 will be described.

More specifically, it will be noted that the Golf Tee and Ball Placer and Holding System 10 comprises hollow shaft member, a tee driver member, golf ball holding member, a golf tee retriever, and a golf tee and ball placer holder.

As best illustrated in FIGS. 1 through 3 and 7, it can be shown that the golf tee and ball placer 10 comprises the hollow shaft member 20 and the tee driver member 60. Referring to FIG. 1 the hollow shaft member 20 has a hollow shaft ground opening 24 in one end and a hollow shaft top plate 26 attached to and covering the opposite end with a top plate opening 28 centered in the hollow shaft top plate 26. A tee receiving opening 22 projects through an exterior surface of the hollow shaft member 20 near the hollow shaft ground opening 24 for receiving a golf tee 16. An upper eyelet hook 12 is attached to the hollow shaft member 20 near the hollow shaft top plate 26, a golf ball holding member 30 is attached to the hollow shaft member 20 near the hollow shaft ground opening 24 and a lower eyelet 14 is attached between the upper eyelet hook 12 and the golf ball holding member 30. The golf ball holding member 30 holds a golf ball 18.

Figure 2:
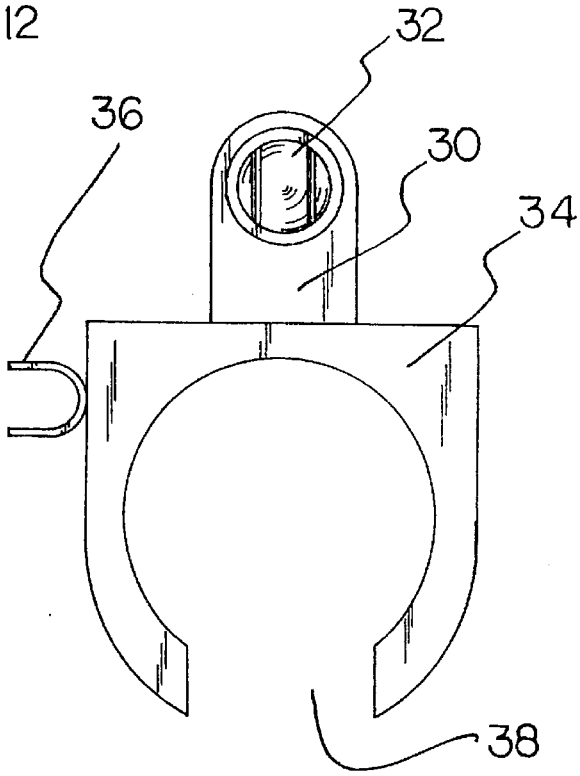
FIG. 2 is a top view of the golf ball holding member and golf tee retriever.
Figure 3:
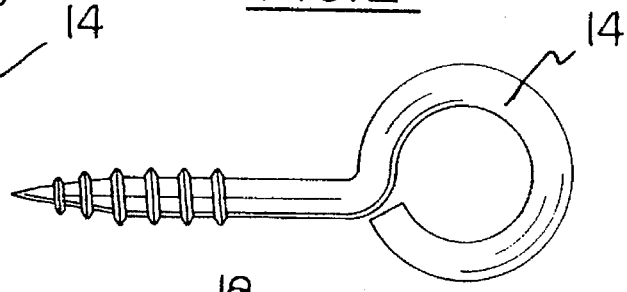
FIG. 3 is an enlarged top view of the lower eyelet.

Now refer to FIGS. 2 and 3, the golf ball holding member 30 includes a hollow shaft member passage 32, a golf ball holder 34, a golf tee retriever 36, and a golf tee slot 38. More specifically, the hollow shaft member 20 is inserted into the hollow shaft member passage 32 attaching the golf ball holding member 30 to the hollow shaft member 20. The golf ball holder 34 has a golf tee slot 38. The golf tee slot 38 allows the golf tee and ball placer 10 to position a golf ball 18 from the golf ball holding member 30 on a golf tee and removing the golf tee and ball placer 10 from around the golf tee leaving the golf ball 18 positioned on the golf tee ready to be played.

A golf tee retriever 36 is attached to the golf ball holder 34. The golf tee retriever 36 is shaped to be able to engage the tee. The golf tee retriever 36 is used to extract the golf tee from the playing surface after utilization. Referring to FIGS. 3 it shows the lower eyelet opening 15 of the lower eyelet 14.

Figure 7:
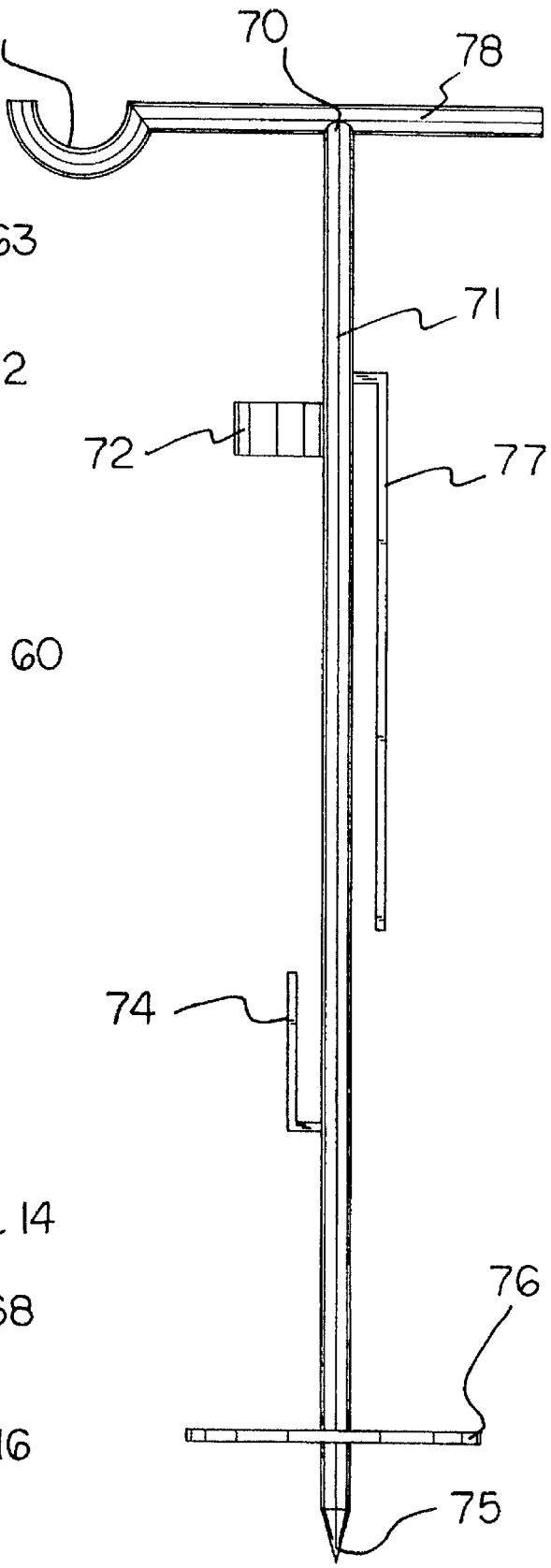
FIG. 7 is a side view of the now Golf Tee and Ball Placer Holder System according to the present invention.

Referring to FIG. 7 which illustrates the golf tee and ball placer holder including placer holder rod 71, an upper 71, an upper rod 71, an upper eyelet 72, a lower eyelet hook 74, a spiked end 75, a stabilization plate 76, a storage hook 77, a handle member 78 and a club holder 79. The handle member 78 secures one end of the club holder 79. The placer holder rod 71 is attached orthogonally to the handle member 78. The upper eyelet 72 is mounted below the handle member 78 on the placer holder rod 71. Attached to the opposing side of the placer holder rod 71 is the storage hook 77. The spiked end 75 is mounted on the end of the placer holder rod 71 opposite the handle member 78. Above the spiked end 75 is attached the stabilization plate 76 and the upper eyelet 72.

The golf tee and ball placer holder 70 is placed into the playing surface for the purpose of holding the golf tee and ball placer 10 by pushing down on the handle member 78 causing the spiked end 75 to penetrate the playing surface to the depth of the stabilization plate 76. The stabilization plate 76 contacts the playing surface providing stability to the golf tee and ball placer holder 70.

Figure 4:
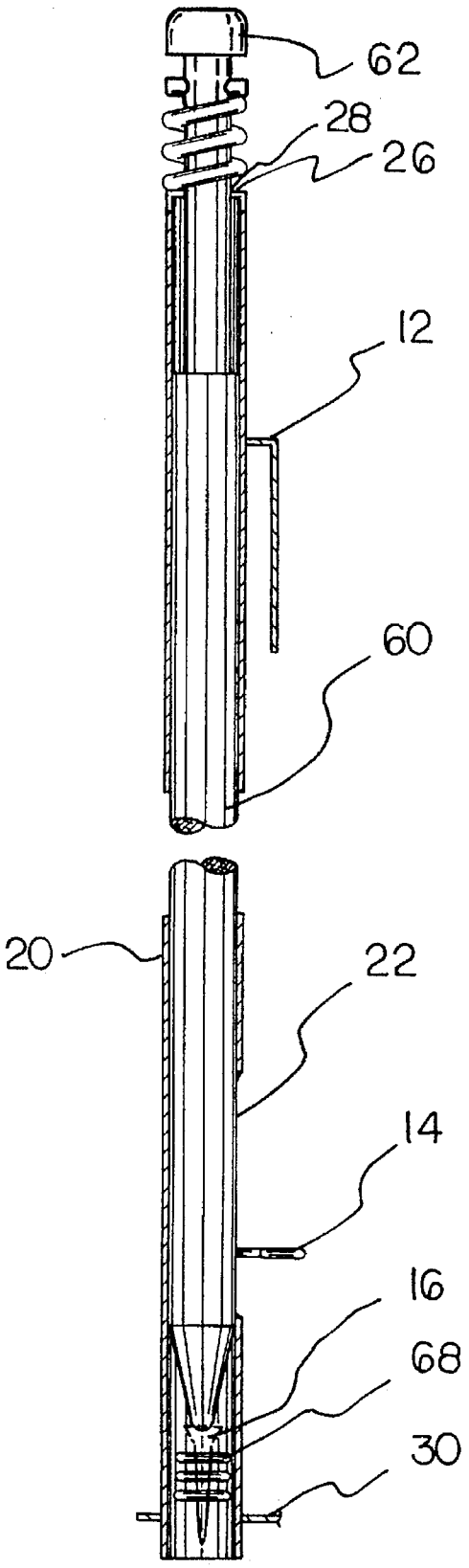
FIG. 4 is side view of the now Golf Tee and Ball Placer and Holding System with the golf tee positioned in the tee retaining means.
Figure 5:
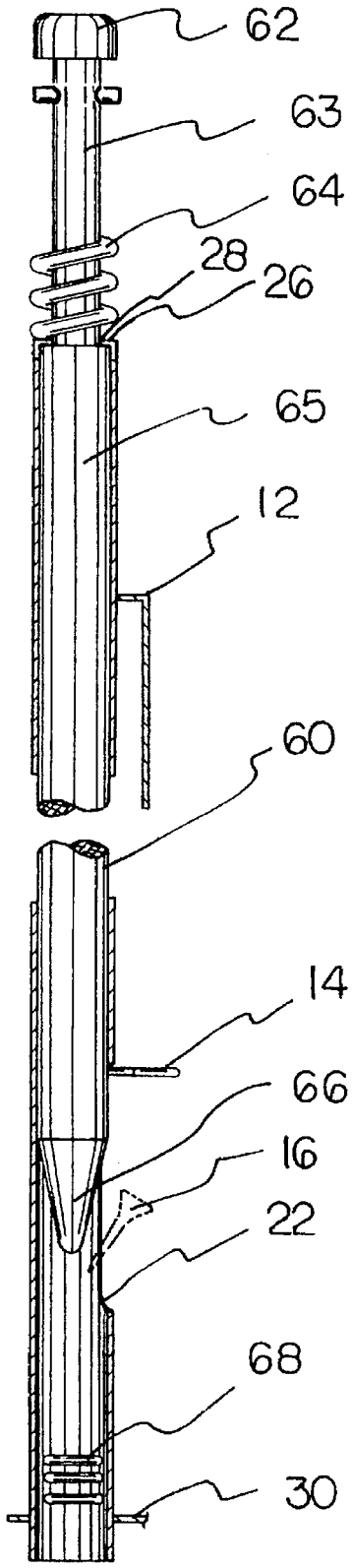
FIG. 5 is side view of the now Golf Tee and Ball Placer and Holding System showing the golf tee being inserted in the tee receiving opening.
Figure 6:
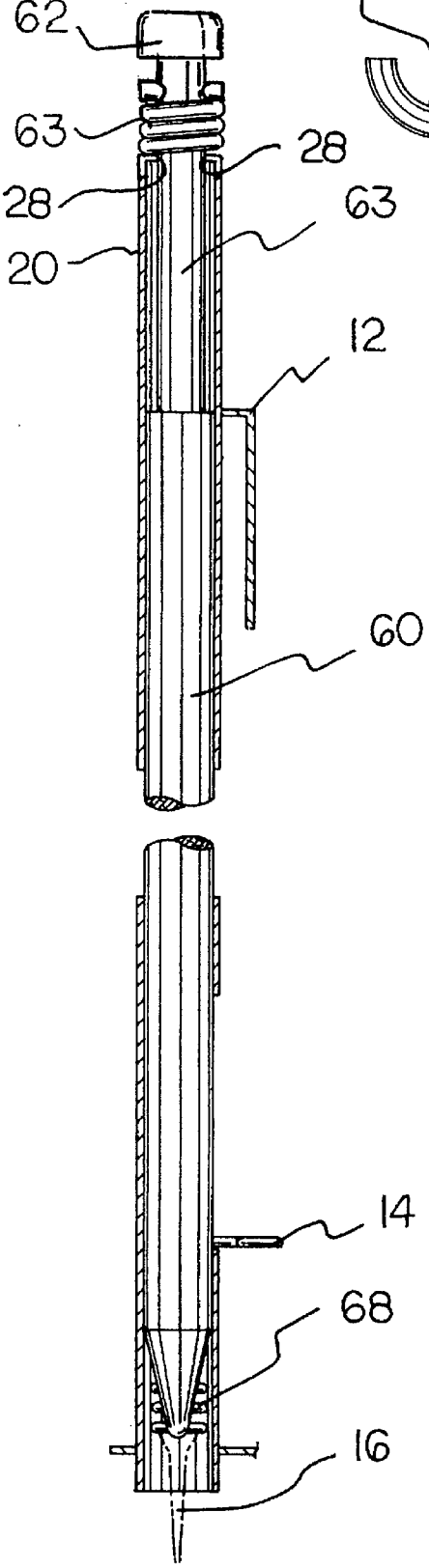
FIG. 6 is side view of the new Golf Tee and Ball Placer and Holding System with the golf tee being projected from the present invention.

FIGS. 4 through 6 illustrate the specifics of the tee driver member 60 and the functions of the golf tee and ball placer 10. The tee driver member 60 includes a tee driver handle 62, a tee driver stop 61, a tee driver handle shaft 63, a spring member 64, a tee driver shaft 65, and a Ice engagement end 66. More specifically, the tee driver handle 62 is coupled to one end of the tee driver handle shaft 63. The tee driver handle shaft 63 end opposite of the tee driver handle 62 projects through the spring member 64 and extends through the top plate opening 28 engaging one end of the tee driver shaft 65. The tee driver stop 61 engages the spring member 64 limiting the penetration of the tee drive handle shaft 63 through the spring member 64. The opposite end of the tee driver shaft 65 secures the tee engagement end 66.

Further, a tee retaining means 68 is mounted inside the hollow shaft member 20 near the hollow shaft ground opening 24. The tee retaining means 68 is in communication with a tee receiving opening 22. The golf tee 16 is inserted through the tee receiving opening 22 into the hollow shaft member 20 mating with the tee retaining means 68. The golf tee 16 is retained in the tee retaining means 68.

In use, the golf tee and ball placer 10 of the present invention can be easily utilized for inserting the golf tee 16 into the playing surface and for placing the golf ball 18 on the said golf tee 16. FIG. 5 displays the tee driver member 60 in a retracted position for insertion of the golf tee 16 into the tee receiving opening 22 entering into the hollow shaft member 20 mating with the tee retaining means 68 capturing the golf tee 16 as to prevent involuntary release of the golf tee 16. As shown in FIG. 4, pressing the said tee driver member 60 extends the tee engagement end 66 to an engaging relationship with the golf tee 16 while compressing the spring member 64. Further, when the tee driver member 60 is in the fully extended position, the said golf tee 16 is projected into the playing surface as shown in FIG. 6 of the drawings. The spring member 64 returns the tee driver member 60 back into the retracted position preparing the golf Ice and ball placer 10 to receive another golf tee 16 as shown in FIG. 5 of the drawings.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationship for the parts of the invention, to include variations in size, materials, shape, form, function and manner of operation, assembly and use, are deemed readily apparent and obvious to one skilled in the art, and all equivalent relationships to those illustrated in the drawings and described in the specification arc intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, failing within the scope of the invention.

What is claimed as being new and desired to be protected by Letters Patent of the United States is as follows:

1. A Golf Tee and Ball Placer and Holding System comprising:

a hollow shaft member;

a tee driver member positioned inside the hollow shaft member;

a golf ball holding member mounted to the hollow shaft member;

a golf tee and ball placer holder for holding the golf tee and ball placer;

the hollow shaft member comprises a hollow shaft ground opening at one end and a hollow shaft top plate including a top plate opening at the opposing end; and a tee receiving opening projects through an exterior surface of the hollow shaft member near the hollow shaft ground opening for receiving a golf tee.

2. The Golf Tee and Ball Placer and Holding System of claim 1, wherein the hollow shaft member includes an upper eyelet hook and a lower eyelet.

3. The Golf Tee and Ball Placer and Holding System of claim 2, wherein the tee driver member comprises a tee driver handle mounted on one end of a tee driver handle shaft whose opposite end attaches to an end of a tee driver shaft whose opposite end forms a tee engagement end.

4. The Golf Tee and Ball Placer and Holding System of claim 3, wherein the tee driver handle shaft is projected through a spring member into the top plate opening wherein the spring member is held in place by the tee driver handle and the hollow shaft top plate.

5. The Golf Tee and Ball Placer and Holding System of claim 4, wherein the penetration of the driver handle shaft is limited by a tee driver stop placed into the driver handle shaft.

6. The Golf Tee and Ball Placer and Holding System of claim 5, wherein the golf ball holding member comprises a hollow shaft member passage for receiving the hollow shaft member.

7. The Golf Tee and Ball Placer and Holding System of claim 6, wherein the golf ball holding member further comprises a golf ball holder.

8. The Golf Tee and Ball Placer and Holding System of claim 7, wherein the golf ball holder includes a golf tee slot and a golf tee retriever.

9. The Golf Tee and Ball Placer and Holding System of claim 8, wherein the golf tee and ball placer holder comprises a placer holder rod with a spiked end and a handle member attached to the placer holder rod opposite the spiked end.

10. The Golf Tee and Ball Placer and Holding System of claim 9, wherein the placer holder rod includes an upper eyelet, a lower eyelet hook, and a storage hook.

11. The Golf Tee and Ball Placer and Holding System of claim 10, wherein the placer holder rod includes a stabilization plate.

* * * * *